US007159430B2

(12) United States Patent
Yogo

(10) Patent No.: US 7,159,430 B2
(45) Date of Patent: Jan. 9, 2007

(54) BENDING DEVICE WITH CUTTING MECHANISM

(75) Inventor: Teruaki Yogo, Seto (JP)

(73) Assignee: Kabushiki Kaisha Opton, Seto (JP)

( * ) Notice: Subject to any disclaimer, the term of this patent is extended or adjusted under 35 U.S.C. 154(b) by 0 days.

(21) Appl. No.: 11/117,116

(22) Filed: Apr. 28, 2005

(65) Prior Publication Data

US 2005/0241356 A1 Nov. 3, 2005

(30) Foreign Application Priority Data

Apr. 30, 2004 (JP) ..... 2004-135798

(51) Int. Cl.
*B21D 7/024* (2006.01)

(52) U.S. Cl. ..... 72/129; 72/149; 72/294

(58) Field of Classification Search ..... 72/149, 72/150, 157, 294, 129
See application file for complete search history.

(56) References Cited

U.S. PATENT DOCUMENTS 4,727,738 A * 3/1988 Yogo ..... 72/157
4,747,293 A 5/1988 Yagi et al.
5,927,124 A * 7/1999 Webster ..... 72/131

FOREIGN PATENT DOCUMENTS

JP 62248527 10/1987
JP 3169433 7/1991
JP 06-182450 7/1994

* cited by examiner

*Primary Examiner*—Lowell A. Larson
(74) *Attorney, Agent, or Firm*—Davis & Bujold, P.L.L.C.

(57) ABSTRACT

The bending device with a cutting mechanism has a bending die corresponding to a desired bending shape, a bending arm that rotates on the bending die, and a clamping die on the bending arm that moves toward a longitudinal workpiece. Corresponding to rotation of the bending arm, the clamping die is rotated around the bending die in order to bend the workpiece. A cutter is provided on the bending arm. The cutter is in a pointed shape having the center of a leading end protruding, and moves toward a workpiece. The clamping die has a groove wherein the cutter can be slid therein. The cutter moves linearly toward a workpiece and cuts the workpiece.

11 Claims, 10 Drawing Sheets

BENDING DEVICE WITH CUTTING MECHANISM

FIELD OF THE INVENTION

This application claims priority from Japanese Application Serial No. 2004-135798 filed Apr. 30, 2004. This invention relates to a bending device with a cutting mechanism, which bends a longitudinal workpiece, such as a pipe, and cuts the bent workpiece.

BACKGROUND OF THE INVENTION

As disclosed in the Unexamined Japanese Patent Publication No. 6-182450, a conventionally known bending device is provided with a bending die corresponding with a shape of bending, a clamping die facing the bending die, a wiper die disposed proximate to the bending die, and a pressure die facing the wiper die. The conventional bending device clamps a workpiece with the bending die and the clamping die, holds the workpiece with the wiper die and the pressure die, and bends the workpiece corresponding to rotation of the bending die.

SUMMARY OF THE INVENTION

An exhaust manifold, for example, is one of the automobile parts for which this type of bending device is used for bending. A pipe for an exhaust manifold is manufactured with several times of bending. In a bending process, it is necessary to provide the pipes with a clamping portion which is approximately 10 cm in length in order to clamp the pipes.

Since the clamping portion provided on an end of a workpiece is linear, this portion needs to be cut if the clamping portion is longer than a desired length. However, in case of consecutive manufacturing of two parts having the same shapes made from one workpiece, suitable length for a clamping portion can be occasionally achieved by cutting the clamping portion into half on a connection portion between the two parts. In this case, it is not preferable to replace a workpiece on a separate cutting device from the bending device in order to conduct cutting on the workpiece, because the number of process steps increases.

There has been a need for a bending device wherein cutting of a workpiece can be conducted without moving a workpiece elsewhere from the bending device.

One of the objects of the present invention is to provide a bending device with a cutting mechanism wherein efficient bending and cutting can be conducted on a workpiece.

To attain the above and other objects, the present invention provides a bending device with a cutting mechanism. In one aspect of the invention of the present application, the bending device with a cutting mechanism comprises: at least one bending die having a surface corresponding to a desired bending shape; a clamping die that is disposed so as to face the bending die, and clamps a workpiece in cooperation with the bending die; a rotation mechanism that rotates the clamping die around the bending die while a workpiece is clamped by the bending die and the clamping die; and a cutter that moves toward a bent workpiece in order to cut the bent workpiece.

The bending device with a cutting mechanism of the present invention can conduct cutting on a workpiece as well as bending. Hence, this device of the present invention is capable of effective manufacturing of products.

The above-described bending device with a cutting mechanism preferably comprises: an input unit to input bending information, including information on the target number of manufactured items to be made from one workpiece; and a cutting position calculation unit that calculates a cutting position of a workpiece.

Moreover, the bending device with a cutting mechanism may comprise a cutting control unit that controls cutting by the cutter so that cutting is conducted as least after a first bending for a second item.

In order to cut a bent workpiece in normal line direction, the cutting control unit may be constituted to automatically control the position of the cutter depending at least on a bending position and a bending angle.

Furthermore, it is preferable for the bending device with a cutting mechanism to comprise: a chuck mechanism that holds a workpiece; and a feeding mechanism that feeds a workpiece held by the chuck mechanism in a longitudinal direction, and moves in a direction perpendicular to the longitudinal direction of the workpiece.

Still furthermore, it is possible to provide the bending device with a cutting mechanism with plurality of bending dies tiered on top of another, and to constitute the above-described feeding mechanism so as to place a workpiece at a position corresponding to a position of one of the tiered bending dies.

BRIEF DESCRIPTION OF THE DRAWINGS

The invention will now be described below, by way of example, with reference to the accompanying drawings.

DETAILED DESCRIPTION OF THE PREFERRED EMBODIMENT

Figure 1:
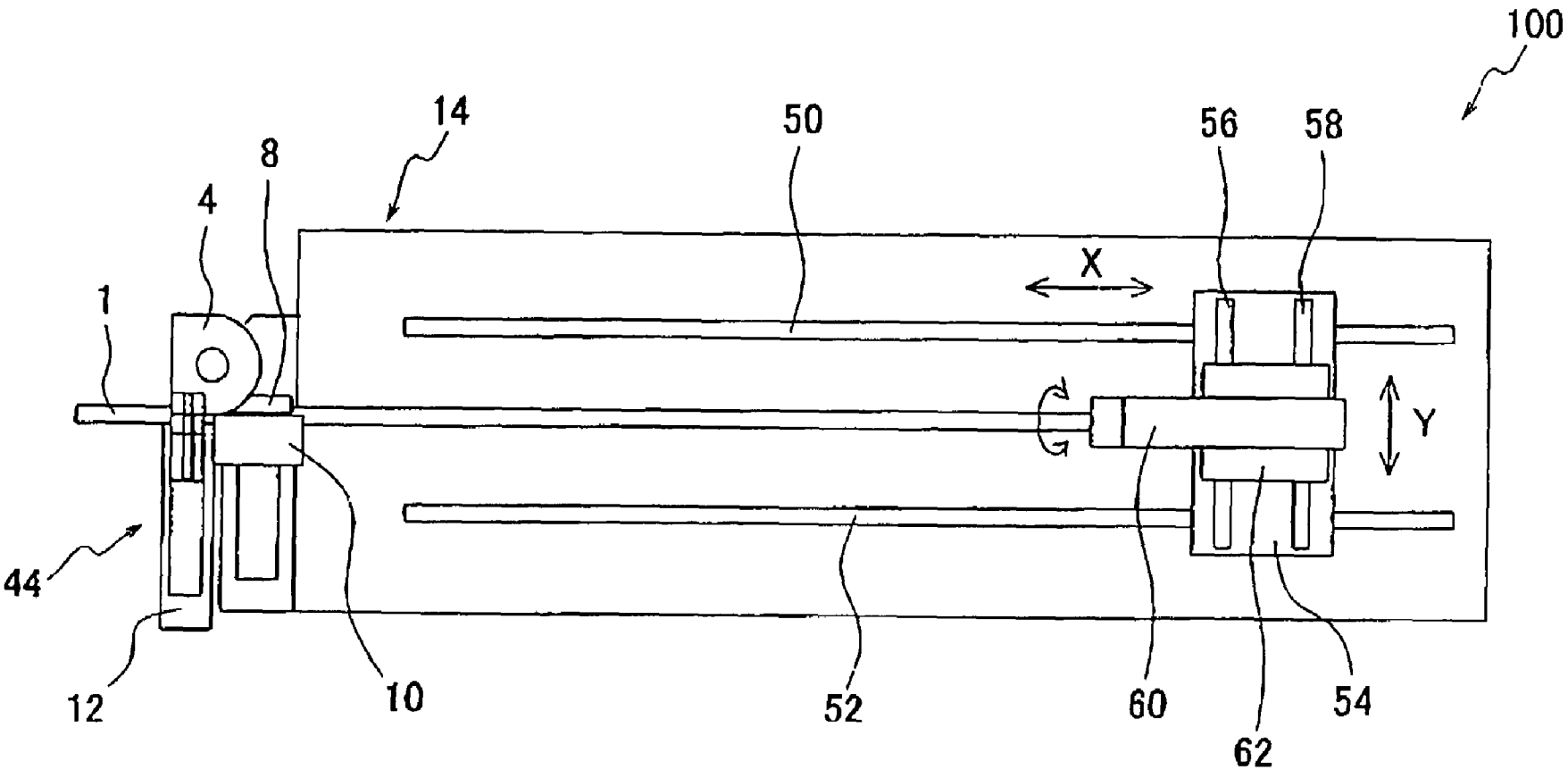
FIG. 1 is a plan view to show the overall structure of a bending device with a cutting mechanism of an embodiment according to the present invention.

Referring to FIG. 1, a bending device with a cutting mechanism 100 of the present embodiment comprises a device main body 14 having one pair of rails 50, 52 laid in parallel to a longitudinal direction of a workpiece 1. A carriage 54 is movably engaged with the rails 50, 52. The carriage 54 has one pair of rails 56, 58 laid in parallel to each other in a direction perpendicular to the workpiece 1.

To the rails 56, 58, a carrying base 62 having a chuck mechanism 60 is movably engaged. The carrying base 62 is constituted to be able to move the chuck mechanism 60, by means of driving motors 116*a* to 116*c* to be described later, in a longitudinal direction of the workpiece 1 (X direction), in a horizontal direction (Y direction) perpendicular to the longitudinal direction of the workpiece 1, and in a vertical direction (Z direction shown in FIG. 3) perpendicular to both the longitudinal direction (X direction) and the horizontal direction (Y direction) of the workpiece 1. The chuck mechanism 60 is constituted so as to be able to hold a rear end of the workpiece 1, and to twist the workpiece 1 around a center of the workpiece 1 in the longitudinal direction while holding.

It is to be noted that the driving motors 116*a* to 116*c* can be replaced with hydraulic cylinders.

As shown in FIG. 1, the chuck mechanism 60 holds the rear end of the workpiece 1, and moves in the X, Y and Z directions. Corresponding to the moving direction of the chuck mechanism 60, the workpiece 1 can be fed in any of these directions.

Figure 2:
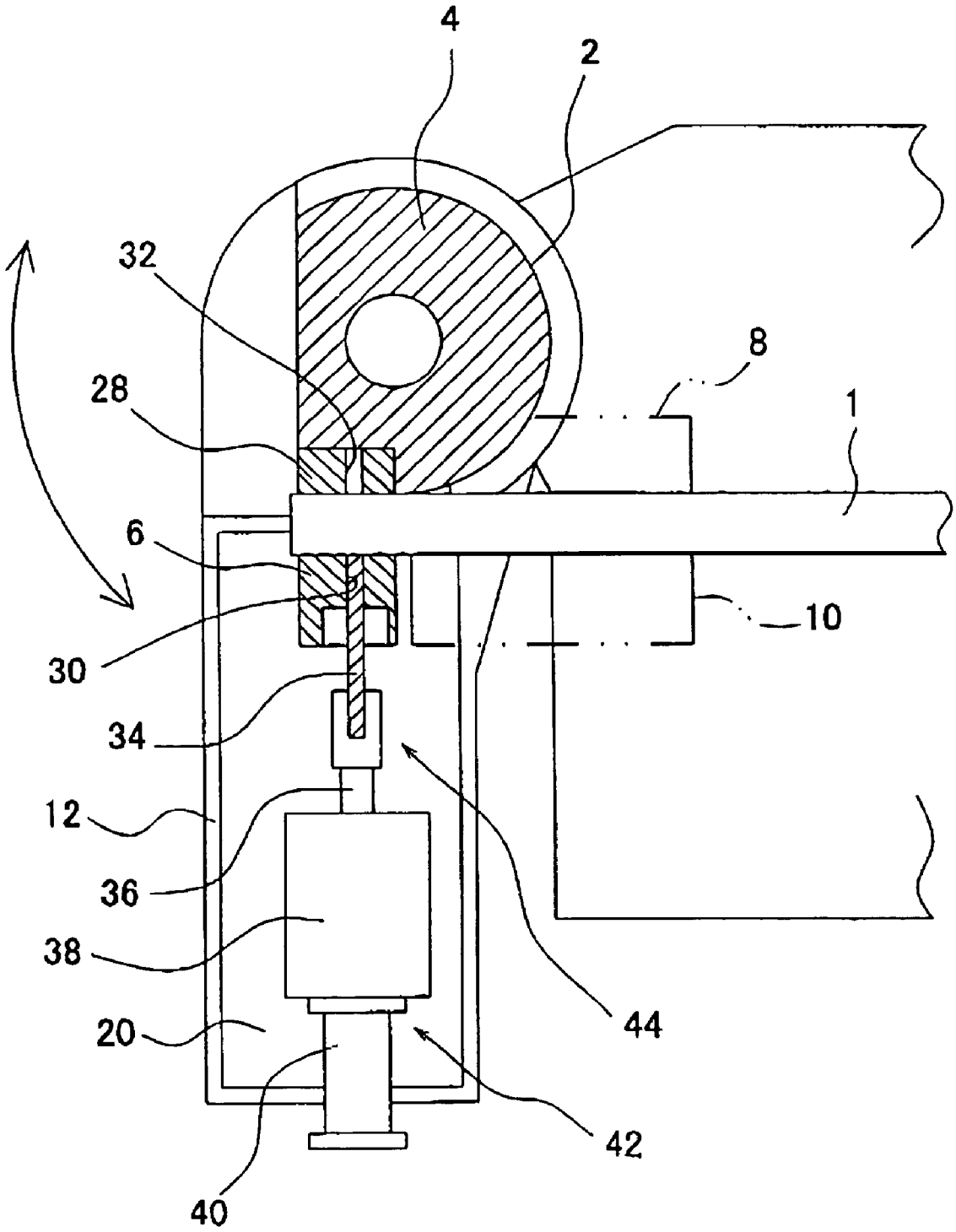
FIG. 2 is a partially enlarged sectional view to show one part of the bending device with a cutting mechanism shown in FIG. 1 in a state before bending.

As shown in FIG. 2, on a rear end of the bending device with a cutting mechanism 100, a bending die 4 is disposed. A clamping die 6 is also provided thereon facing the bending die 4. The bending die 4 is provided with a bending groove 2 corresponding to the contour of the workpiece 1 to form a target bending shape. It is shown with a chain double-dashed line in FIG. 2 that a wiper die 8 is provided adjacent to the bending die 4, and that a pressure die 10 is provided facing the wiper die 8. The pressure die 10 is constituted to be able to move, by a hydraulic cylinder or a motor not shown in the drawing, toward the workpiece 1, and to hold the workpiece 1 together with the wiper die 8. It should be noted that the wiper die 8 and pressure die 10 can be provided if necessary.

Figure 3:
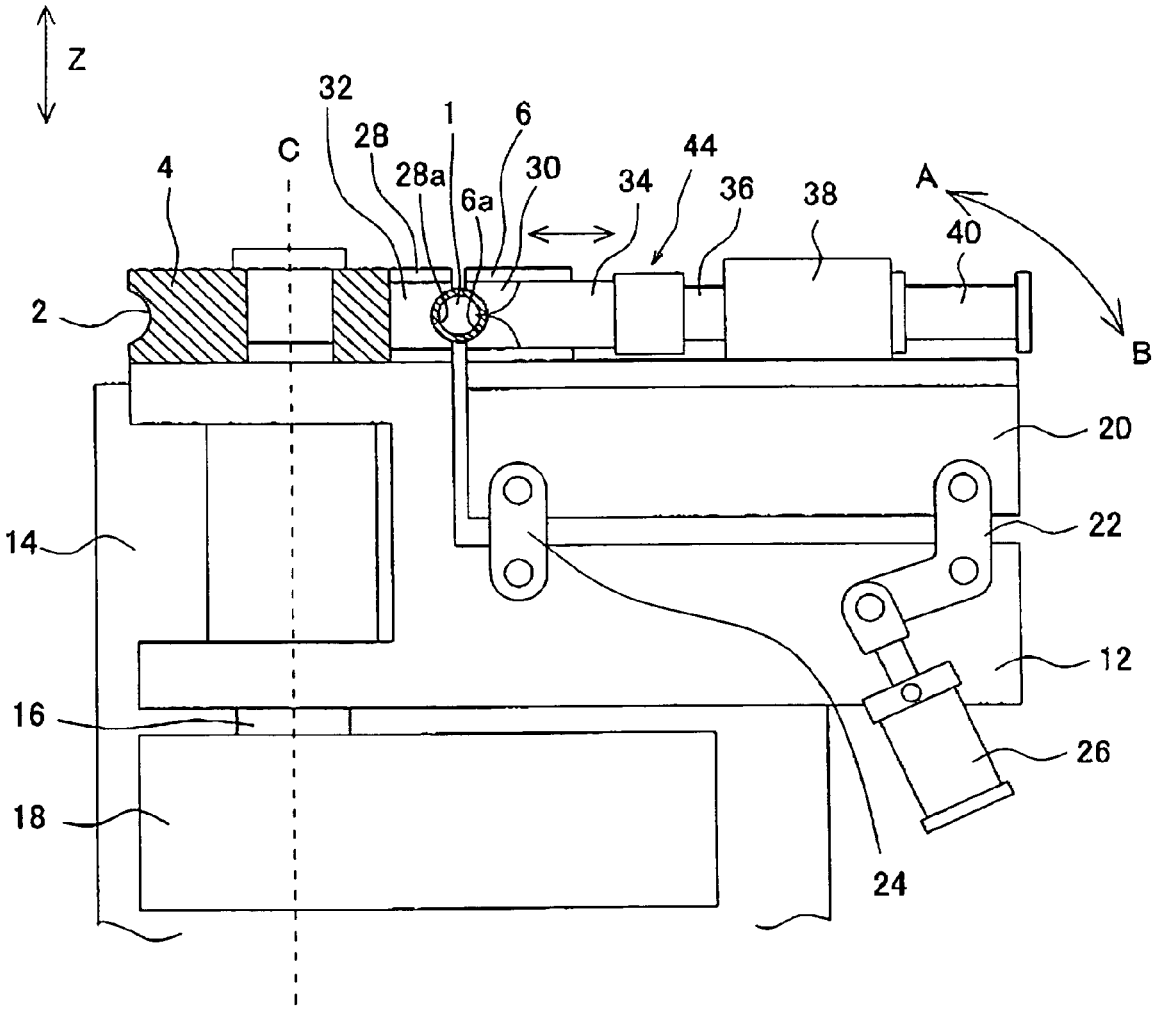
FIG. 3 is a front elevation view to show one part of the bending device with a cutting mechanism shown in FIG. 2.

As shown in FIGS. 2 and 3, the bending die 4 is attached to a bending arm 12. The bending arm 12 is supported by the device main body 14 to be rotateble via a driving shaft 16 around an axis C. The bending arm 12 is driven to rotate on the driving shaft 16 (axis C) by a bending drive mechanism 18 provided on the device main body 14.

The bending drive mechanism 18 rotates the bending arm 12 around the driving shaft 16 by rotating the driving shaft 16 by a hydraulic cylinder or a link mechanism not shown in the drawing. A hydraulic motor or an electric motor can be used to rotate the driving shaft 16 instead of the above-described hydraulic cylinder.

On the bending arm 12, a clamping platform 20 is swingablly supported by a driving link 22 and a driven link 24. A parallel link is formed by the driving link 22 and the driven link 24. A rod of a hydraulic cylinder 26 swingablly supported by the bending arm 12 is connected to the driving link 22. Although it is not shown in the drawing, a same constitution with the driving link 22, driven link 24 and hydraulic cylinder 26 is also provided in the opposite side of the lateral surface of the clamping platform 20 shown in FIG. 3.

The clamping die 6 is attached on the clamping platform 20. When the clamping platform 20 is moved by driving the hydraulic cylinder 26 in the direction of Arrow A, the clamping die 6 moves toward the bending die 4. To the contrary, when the clamping platform 20 is moved by driving the hydraulic cylinder 26 in the direction of Arrow B, the clamping die 6 moves in a direction to be away from the bending die 4. The clamping die 6 has a groove 6*a* formed to be corresponding to the contour of the workpiece 1. Facing the clamping die 6, a fastening die 28 is integrally attached to the bending die 4. The fastening die 28 has a groove 28*a* formed to be corresponding to the contour of the workpiece 1. The groove 6*a* of the clamping die 6 and the groove 28*a* of the fastening die 28 are both formed linearly along the axial direction of the workpiece 1. The groove 28*a* of the fastening die 28 is connected to the bending groove 2 of the bending die 4. It should be noted that the grooves 6*a* and 28*a* can be formed in a curved shape depending on a desired bending shape.

The clamping die 6 and the fastening die 28 have enough lengths to be able to provide holding force for wrapping the workpiece 1 around the bending groove 2 of the bending die 4 without the workpiece 1 being removed from the clamping die 6 and the fastening die 28 when the workpiece 1 is clamped by the clamping die 6 and the fastening die 28, and the bending arm 12 is rotated on the driving shaft 16 for bending the workpiece 1.

The clamping die 6 has a groove 30 extending in a direction perpendicular to the axial direction of the workpiece 1. The fastening die 28 also has a groove 32 formed in the same shape as the groove 30 and disposed in an extension of the groove 30. In the groove 30 of the clamping die 6, a disk cutter 34 is inserted slidably. As shown in FIG. 3, the cutter 34 is formed in a pointed shape wherein the center of the leading end is protruding, and disposed in a way so that the leading end strikes the center of the workpiece 1. The cutter 34 is formed to have a length larger than the diameter of the workpiece 1, so that the workpiece 1 can be cut when the cutter 34 is pressed against the workpiece 1 in normal line direction.

The cutter 34 is fixed to the leading end of a sliding member 36. The sliding member 36 is guided by a guide member 38 attached on the clamping platform 20, and slides in a direction orthogonal to the axial direction of the workpiece 1. The sliding member 36 is slid by a hydraulic cylinder 40 attached to the guide member 38. In other words, the workpiece 1 can be cut by pushing the sliding member 36 with the hydraulic cylinder 40 toward the workpiece 1.

The sliding member 36, guide member 38 and cylinder 40 constitute a cutting drive mechanism 42. The cutter 34 and the cutting drive mechanism 42 constitute a cutting mechanism 44.

Figure 4:
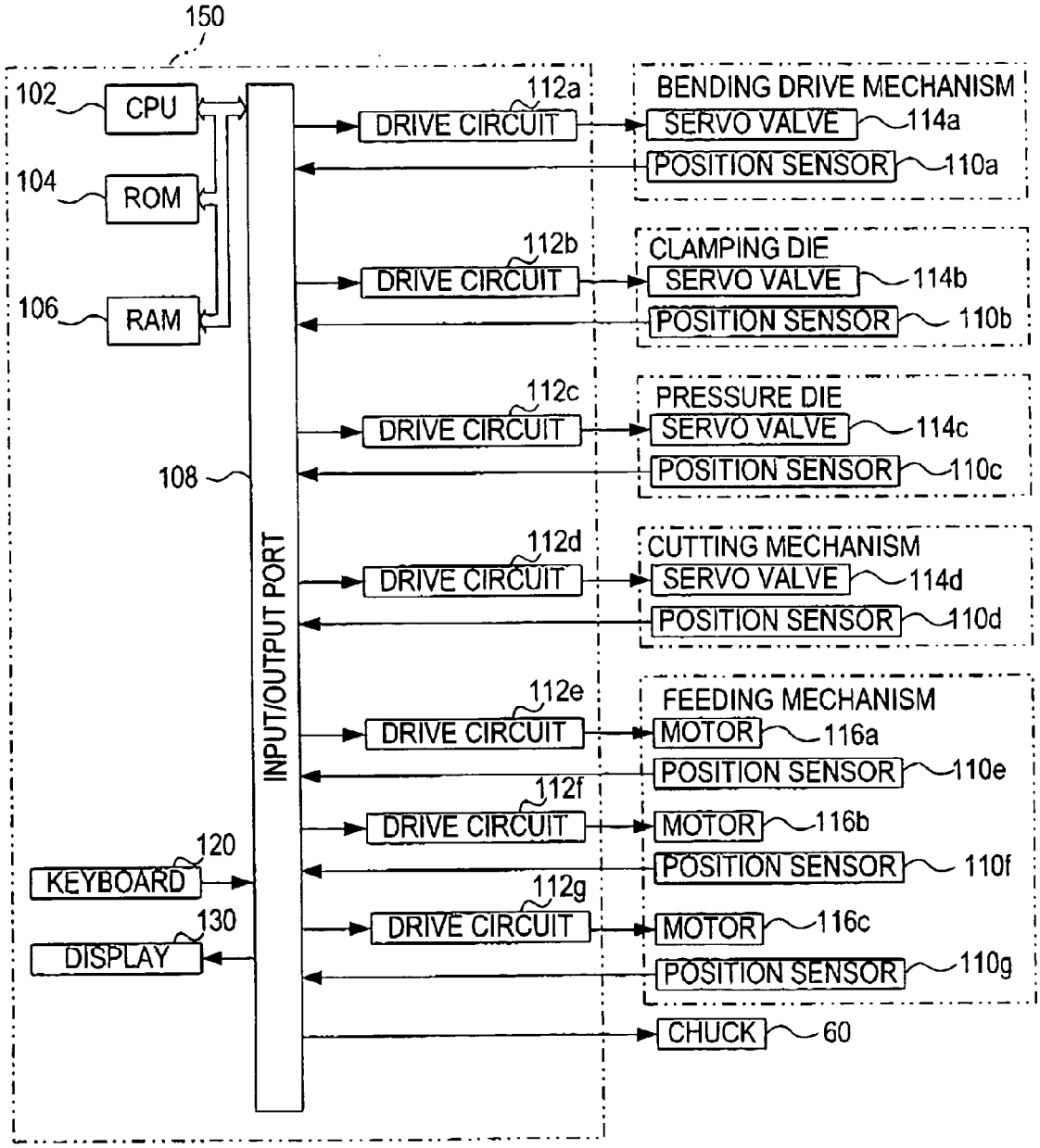
FIG. 4 is a block diagram to show the electrical structure of the bending device with a cutting mechanism of the embodiment.

Referring now to FIG. 4, the electric structure of the bending device with a cutting mechanism 100 will be described below.

An electronic controller 150 of the bending device with a cutting mechanism 100 comprises: CPU 102 that controls operation of various mechanisms; ROM 104 that stores programs to execute bending and cutting; and RAM 106 that conducts various calculation processes and stores data. These units 102, 104 and 106 are all connected to an input/output port 108.

The CPU 102 inputs signals from position sensors 110*a* to 110*g* via the input/output port 108.

The position sensor 110*a* is used in order to detect the rotational angle position of the driving shaft 16 included in the bending drive mechanism 18, that is the rotational angles of the bending die 4 and the bending arm 12. The position sensor 110*a* is constituted with an encoder. The position sensor 110*b* detects the leading end and the rear end of the clamping die 6 which moves toward the bending die 4 and away from the bending die 4 when bending on the workpiece 1 is in process. The position sensor 110*c* detects the leading end and rear end of the clamping die 6 which moves toward the workpiece 1 and away from the workpiece 1 when bending on the workpiece is in process. The position sensors 110*b* and 110*c* are respectively constituted with limit switches. The position sensor 110*d* detects the position of the cutter 34 included in the cutting mechanism 44, and is constituted with an encoder.

The position sensor 110*e* detects the position of the carriage 54 (the chuck mechanism 60) in X direction by detecting rotation of the motor 116*a*. The position sensor 110*f* detects the position of the chuck mechanism 60 in Y direction by detecting rotation of the motor 116*b*. The position sensor 110*g* detects the position of the chuck mechanism 60 in Z direction by detecting rotation of the motor 116*c*. The position sensors 110*e* to 110*g* are respectively constituted with an encoder.

The CPU 102 outputs control signals via the input/output port 108 and drive circuits 112*a* to 112*g* based on data from the sensors 110*a* to 110*g* and memory data stored in the ROM 104 and RAM 106, and controls each driving system of the bending device with a cutting mechanism 100.

A servo valve 114*a* shown in FIG. 4 controls hydraulic pressure given to the hydraulic cylinder included in the bending drive mechanism 18. A servo valve 114*b* controls hydraulic pressure given to the hydraulic cylinder 26 that actuates the clamping die 6. The servo valve 114*c* controls hydraulic pressure given to the hydraulic cylinder that actuates the pressure die 10. The serve valve 114*d* controls hydraulic pressure given to the hydraulic cylinder 40 included in the cutting mechanism 44. To the input/output port 108, a keyboard 120 for inputting bending information and a display 130 that shows inputted information thereon are furthermore connected.

Figure 5:
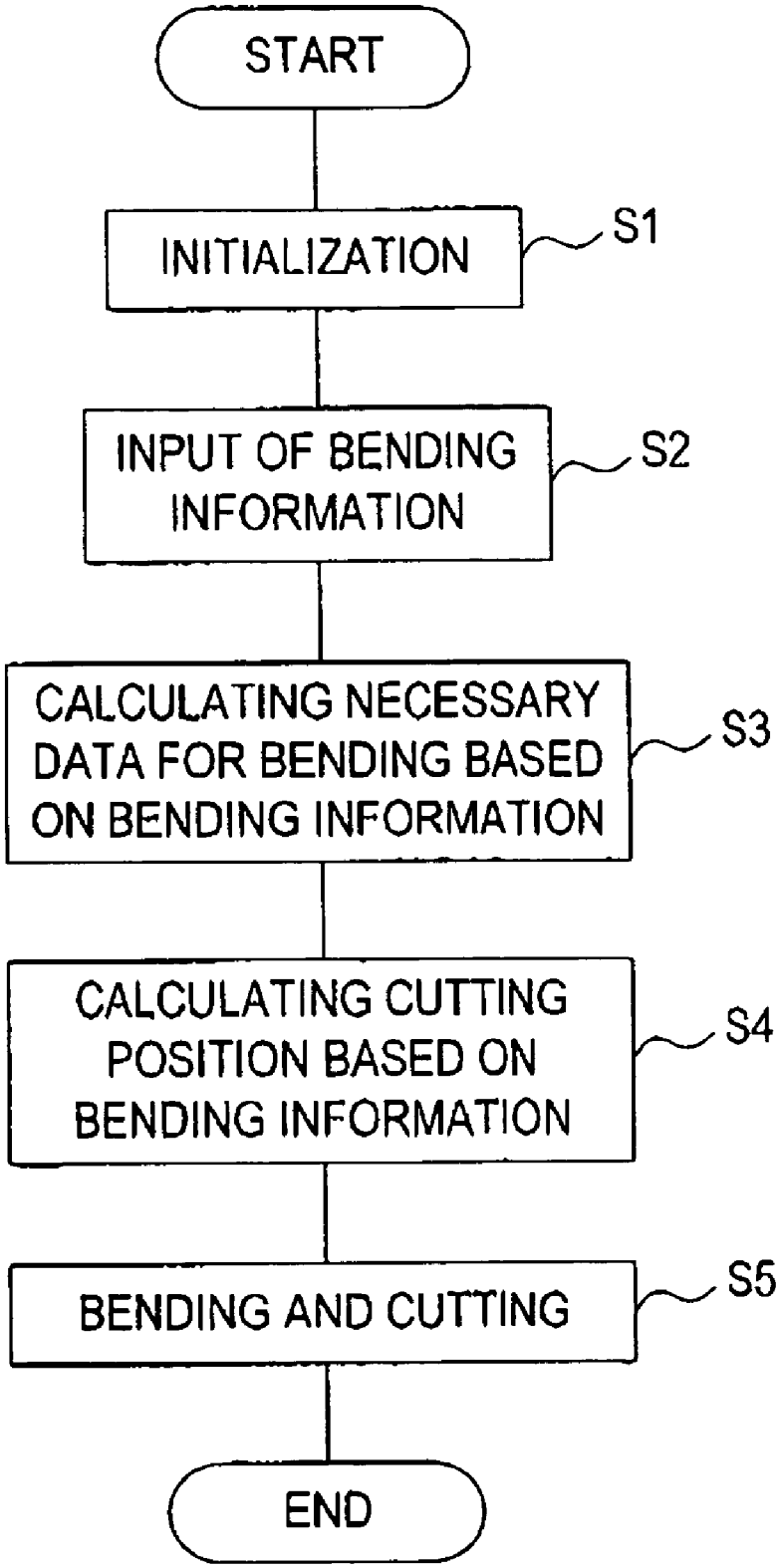
FIG. 5 is a flowchart showing the operation procedures of the bending device with a cutting mechanism of the embodiment.

The following describes the operation of the bending device with a cutting mechanism 100 with reference to FIG. 5.

In S1, the CPU 102 executes initialization in order set the bending device with a cutting mechanism 100 in a operatable state.

In S2, bending information is inputted via the keyboard 120. The bending information includes the shape of a workpiece, the material of the workpiece, bending position, bending direction, bending angle, and the number of manufactured items to be made from a workpiece.

In S3, necessary data for actual bending are calculated based on the inputted bending information. The following data can be, for example, calculated: clamping pressure for clamping a workpiece 1, distance and timing for moving the workpiece 1 in X, Y and Z directions, a rotational angle (bending angle) and timing of the bending die 4, timing for relieving clamping on the workpiece 1, and a twisting angle and timing for twisting the workpiece 1.

In S4, a cutting position on the workpiece 1 is calculated based on the inputted bending information. The cutting position can be, for example, calculated depending on the number of manufactured items to be made from the workpiece 1.

In S5, bending and cutting are conducted.

First, a workpiece 1 is placed in the groove 28*a* of the fastening die 28. The hydraulic cylinder 26 is driven to swing the driving link 22. Consequently, the clamping platform 20 is moved horizontally, and the clamping die 6 is moved toward the fastening die 28. The circumference of the workpiece 1 is clamped by the groove 28*a* of the fastening die 28 and the groove 6*a* of the clamping die 6. As shown in FIG. 2, the workpiece 1 is held by the wiper die 8 and the pressure die 10.

Subsequently, the bending drive mechanism 18 is driven to rotate the bending arm 12 around the driving shaft 16, and thereby to rotate the clamping die 6 around the bending die 4. The carriage 54 is moved in order to feed the workpiece 1 in X direction. As a result, while the leading end of the workpiece 1 is clamped by the clamping die 6 and the fastening die 28, bending on the workpiece 1 is conducted by the workpiece 1 being drawn out and wrapped around the bending groove 2 of the bending die 4.

Figure 6:
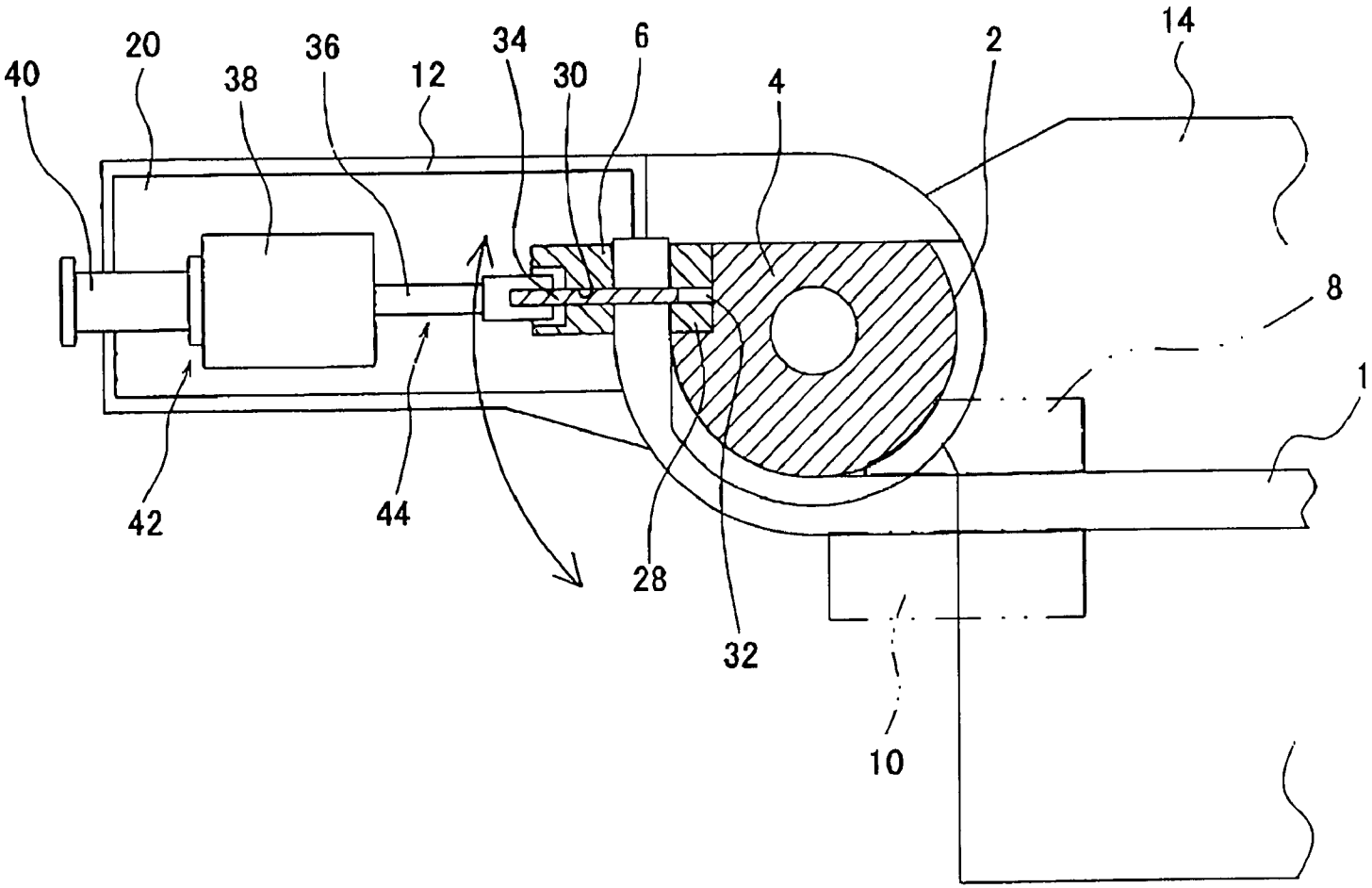
FIG. 6 is a partially enlarged sectional view to show one part of the bending device with a cutting mechanism shown in FIG. 1 in a state after bending.

As shown in FIG. 6, the workpiece 1 can be bent with a predetermined angle by rotating the bending arm 12 for predetermined angle.

Following the bending, the cylinder 40 is driven to slide the sliding member 36 and to move the cutter 34 in the groove 30 toward the workpiece 1. Consequently, when the cutter 34 moves into the groove 32 of the fastening die 28 from the groove 30 of the clamping die 6, the workpiece 1 is cut by the cutter 34.

After cutting is conducted, the cylinder 40 is driven to move back the cutter 34, and the hydraulic cylinder 26 is driven to move the clamping die 6 away from the fastening die 28. The clamping on the workpiece 1 is therefore relieved. The bending arm 12 is rotated around the driving shaft 16 by the bending drive mechanism 18 to be replaced at an original position.

After feeding the workpiece 1 for predetermined distance in the axial direction by the carriage 54, the hydraulic cylinder 26 is once again driven to clamp the workpiece 1 by the clamping die 6 and the fastening die 28. The workpiece 1 can be twisted around the axial direction thereof, and then clamped. Subsequently, the bending arm 12 is rotated for predetermined angle by the bending drive mechanism 18 to conduct bending on the workpiece. 1.

Following the bending on the workpiece 1 in a required shape, the cylinder 40 is driven to slide the sliding member 36 and cut the workpiece 1 by the cutter 34. Because of the cutting conducted on the workpiece 1 by the cutter 34, cutting of the workpiece 1 can be done simultaneously with completion of bending. Therefore, cutting can be conducted easily without removing a bent workpiece 1 from a bending device.

It is also possible to conduct cutting as follows after bending is conducted by rotating the bending arm 12. The bending arm 12 is replaced to the original position, as shown in FIG. 2. The workpiece 1 is clamped by the clamping die 6 and the fastening die 28. The cylinder 40 is driven and the workpiece 1 is cut by the cutter 34. After the cutting, bending can be once again conducted after the clamping on the workpiece 1 by the clamping die 6 and the fastening die 28 is temporarily relieved, and the workpiece 1 is fed in the axial direction.

According to the present embodiment wherein the grooves 30 and 32 are formed respectively on the clamping die 6 and the fastening die 28, and the cutter 34 is inserted into the grooves 30 and 32, cutting can be easily and effectively conducted for manufacturing a product having a linear portion that is shorter than the widths of the clamping die 6 and the fastening die 28. Moreover, by having the cutter 34 in a pointed shape wherein the center of the leading end is protruding, the shape of the workpiece 1 can be preserved without being squashed.

The present embodiment gives an example of bending wherein the workpiece 1 is pulled and bent with the bending device 100 having the fastening die 28 integrally constituted with the bending die 4, and the bending die 4 being rotated together with the bending arm 12. However, a way of bending is not limited to the above example. It is also possible to conduct bending on the a workpiece 1 by pushing and bending the workpiece 1 with a bending device wherein a bending die 4 formed virtually in a circular shape is fixed to a device main body 14, a fastening die 28 is provided on a bending arm 12, and a clamping die 6 and the fastening die 28 are rotated around a bending die 4 corresponding with rotation of the bending arm 12.

FIGS. 7A to 7D and FIG. 8A to 8D illustrate an example wherein a workpiece 1 is bent several times and cutting thereof is conducted.

Figure 7A:
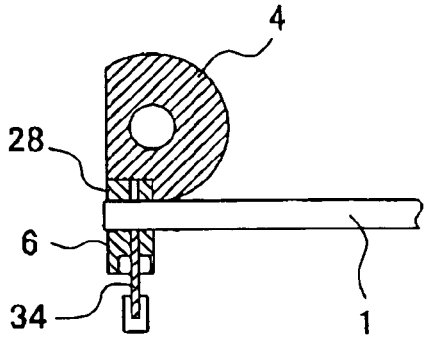
FIGS. 7A to 7D are explanatory views illustrating the first half of a cutting process conducted after several times of bending by the bending device with a cutting mechanism of the embodiment.
Figure 7B:
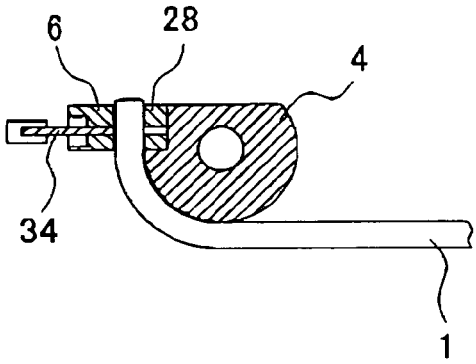

As shown in FIG. 7A, the workpiece 1 is clamped by the clamping die 6 and the fastening die 28. In FIG. 7B, the bending arm 12 is rotated and the chuck mechanism 60 is moved in the longitudinal direction of the workpiece 1 to bend the workpiece 1 for 90 degree.

Figure 7C:
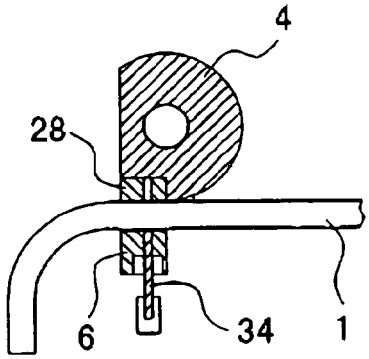
Figure 7D:
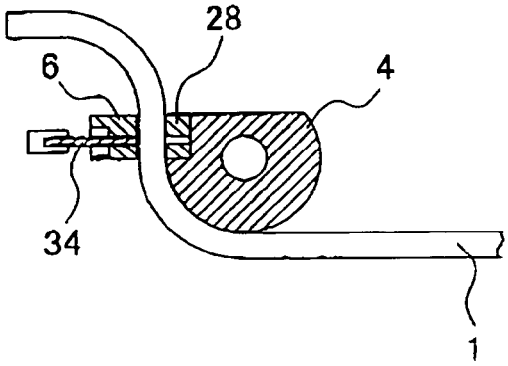

Subsequently, as shown in FIG. 7C, the bending arm 12 is replaced to the original position, and the workpiece 1 is fed by the chuck mechanism 60 in the longitudinal direction to twist the workpiece 1 for 180 degree. In FIG. 7D, the workpiece 1 is once again clamped by the clamping die 6 and the fastening die 28, and the bending arm 12 is rotated to bend the workpiece 1 for 90 degree.

Figure 8A:
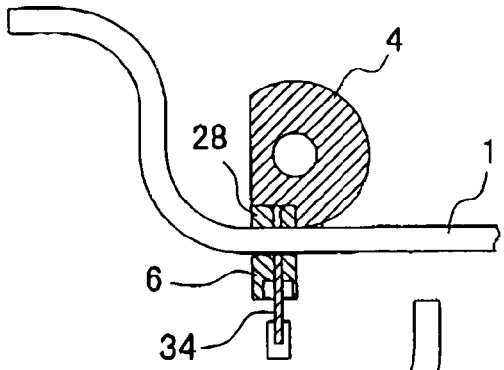
FIGS. 8A to 8D are explanatory views illustrating the second half of the cutting process conducted after several times of bending by the bending device with a cutting mechanism of the embodiment.
Figure 8B:
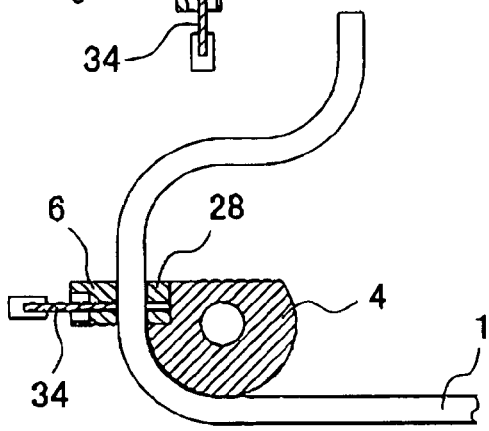
Figure 8C:
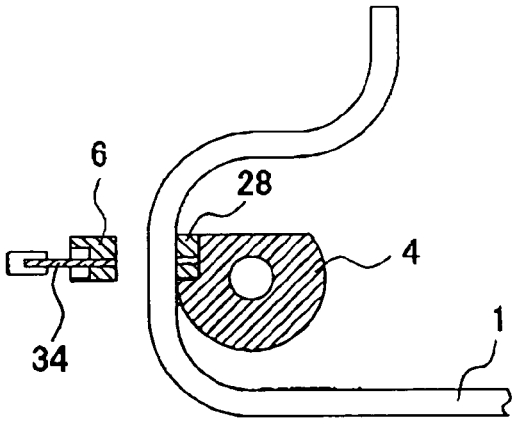

Following the bending in FIG. 7D, in FIG. 8A, the bending arm 12 is replaced to the original position, and the workpiece 1 is fed by the chuck mechanism 60 in the longitudinal direction. As shown in FIG. 8B, the workpiece 1 is clamped by the clamping die 6 and the fastening die 28, and the bending arm 12 is rotated to bend the workpiece 1 for 90 degree. In FIG. 8C, while the clamping die 6 is positioned away from the fastening die 28, the chuck mechanism 60 is moved in parallel along the rails 56 and 58 so that the cutting portion on the workpiece 1 is moved to face the cutter 34.

Figure 8D:
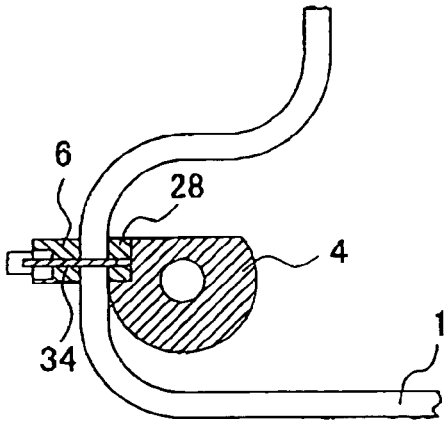

As shown in FIG. 8D, after the clamping die 6 is moved toward the fastening die 28, and the workpiece 1 is clamped by the clamping die 6 and the fastening die 28, the cutter 34 is moved toward the workpiece 1 to conduct cutting. Consequently, the workpiece 1 can be cut in a required shape, and the workpiece 1 can be cut so as to have a linear portion shorter than the length of the clamping die 6 after bending.

Figure 9:
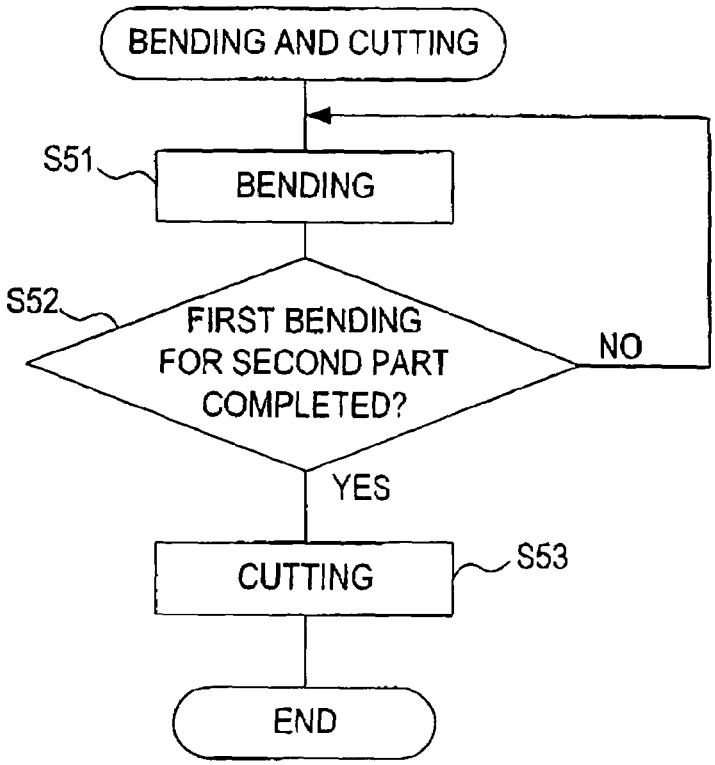
FIG. 9 is a flowchart showing a variation of the bending and cutting process.

In case two or more parts are manufactured from one workpiece 1, if cutting on the workpiece 1 is conducted in the middle of manufacturing, it sometimes happens that sufficient length cannot be maintained on an end of the workpiece 1 for clamping the workpiece 1 with the bending die 4 and clamping die 6 for subsequent bending. In order to avoid this kind of problem, the process shown in FIG. 9 can be adopted in S5 shown in FIG. 5.

In S51, bending is conducted. In S52, it is determined whether or not bending has been completed up to a first bending for a second part. If bending for a first part has been completed but not the first bending for the second part (S52:NO), the process goes back to S51 and the first bending for the second part is conducted. If the first bending for the second part has been completed (S52:YES), the process proceeds to S53 to conduct cutting on the workpiece 1. Since the first bending for the second part has been done, it is not necessary to clamp the leading end of the second part with the bending die 4 and the clamping die 6. Therefore, the above-described problem can be inhibited.

Figure 10:
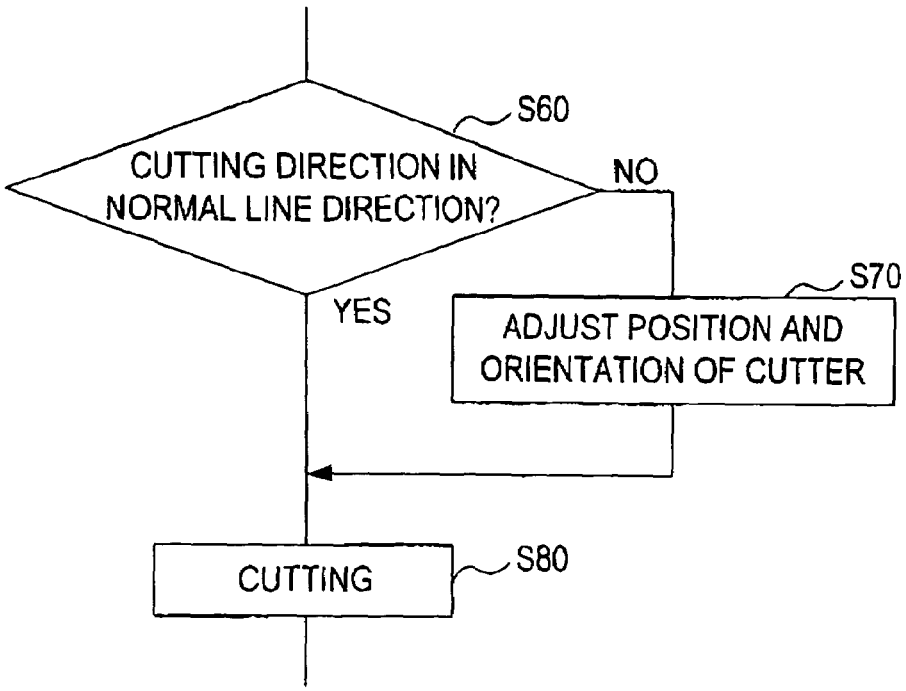
FIG. 10 is a flowchart showing a variation of the cutting process.

When cutting is conducted on the workpiece 1 by the cutter 34, it is preferable to cut the workpiece 1 in the normal line direction in relation to the longitudinal direction of the workpiece 1. For this purpose, the process shown in FIG. 10 can be adopted.

Prior to the cutting step S80, the following steps are conducted. In S60, it is determined whether or not the cutting direction by the cutter 34 is in the normal line direction in relation to the workpiece 1. For this determination, a sensor can be provided to detect direction of the cutter 34 at a cutting position. If the cutting direction is not in the normal line direction (S60:NO), the process goes to S70 to adjust the position and orientation of the cutter 34. Subsequently, the process proceeds to S80 and cutting process is conducted as described above.

Figure 11:
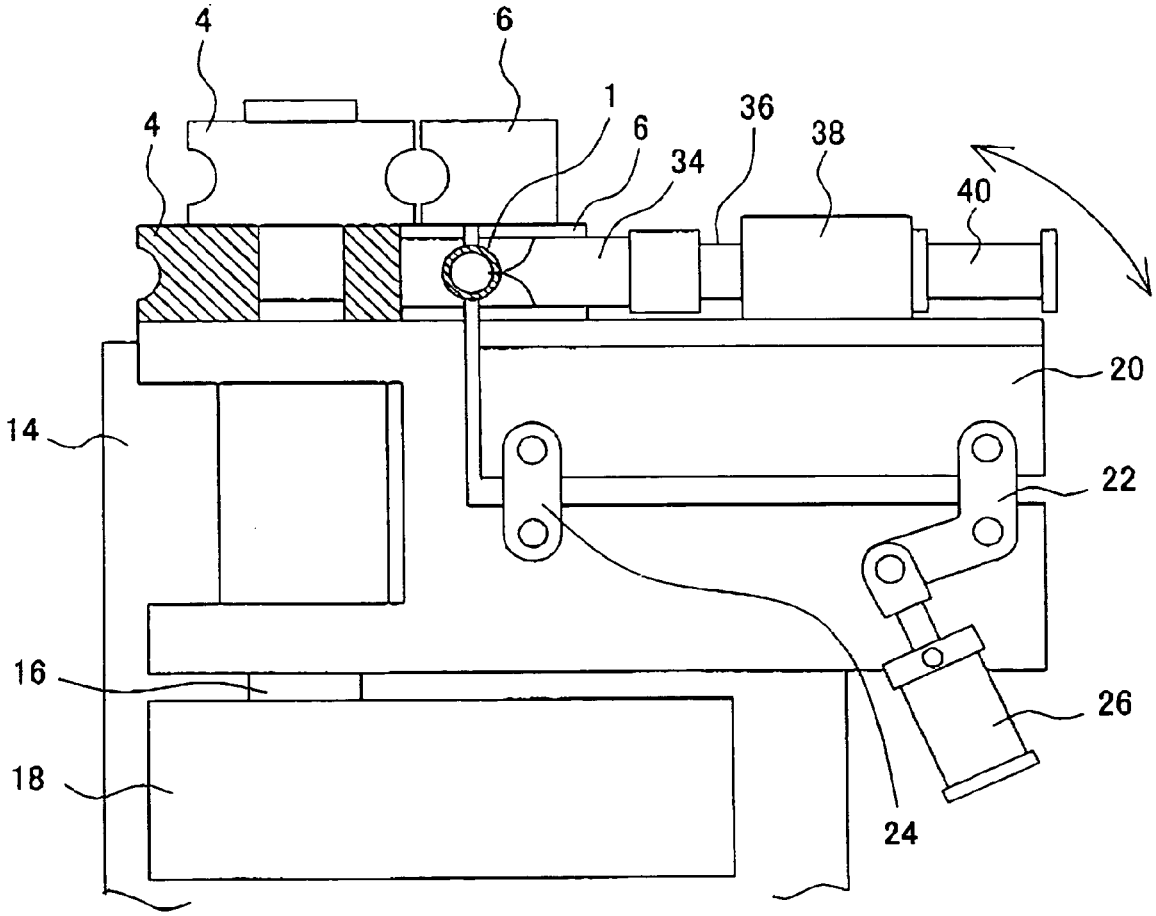
FIG. 11 is a partially enlarged view to show a bending device with a cutting mechanism of another embodiment according to the present invention.

It is to be noted that the present invention is not limited to the above-described embodiments. Variations and modifications are possible within the scope of the invention. For example, as shown in FIG. 11, a plurality of bending dies tiered on top of another can be used for the bending die 4. In this case, bending and cutting can be conducted after placing a workpiece by a feeding mechanism to a position corresponding to the position of a desired bending die amongst the plurality of the tiered dies.

What is claimed is:

1. A bending device with a cutting mechanism for bending and cutting a workpiece, the bending device comprising:

at least one bending die having a bending surface corresponding to a target bending shape and a bending axis perpendicular to and offset from a longitudinal axis of the workpiece;

a bending arm rotatable about the bending axis and including a clamping die disposed to face the bending die and positionable along a bending arm axis to clamps the workpiece against the bending die; and a cutter movable along the bending arm axis for cutting the workpiece at a selectable angle of rotation of the bending arm; and a rotation mechanism for rotating the bending arm around the bending axis while the workpiece is clamped by the clamping die and the bending die for at least one of bending the workpiece to conform to the target bending shape; and positioning the cutter at the selectable angle of rotation for cutting the workpiece.

2. The bending device with a cutting mechanism as set forth in claim 1, further comprising:

an input unit for inputting bending information including a number of manufactured items to be made from a single workpiece; and a cutting position calculation unit that calculates a cutting position of the workpiece in accordance with the number of manufactured items to be made from the single workpiece.

3. The bending device with a cutting mechanism as set forth in claim 2, further comprising:

a cutting control unit that controls cutting by the cutter to be conducted at least after a first bending for a second manufactured item.

4. The bending device with a cutting mechanism as set forth in claim 3 wherein:

the cutting control unit automatically controls a position of the cutter depending at least on a bending position and bending angle in order to cut the bent workpiece in a line normal to the longitudinal axis of the workpiece at the selectable angle of rotation for cutting the workpiece.

5. The bending device with a cutting mechanism as set forth in claim 1 wherein the cutter is disk shaped and capable of cutting the workpiece by moving linearly toward the workpiece.

6. The bending device with a cutting mechanism as set forth in claim 5 wherein the cutter has a pointed shape with a leading edge formed as a point disposed to strike a diametric center of the workpiece.

7. The bending device with a cutting mechanism as set forth in claim 1 wherein the workpiece is a pipe.

8. The bending device with a cuffing mechanism as set forth in claim 1 further comprising:

a chuck mechanism for holding the workpiece, and a feed mechanism including a longitudinal drive mechanism for moving the chuck along the longitudinal axis of the workpiece held by the chuck and a transverse drive mechanism for moving the chuck in at least one direction perpendicular to the longitudinal axis of the workpiece held by the chuck.

9. The bending device with a cutting mechanism as set forth in claim 8 comprising a plurality of bending dies tiered on tope of another, and wherein the feed mechanism places the workpiece to a position corresponding to a position of one of the tiered bending dies.

10. The bending device with a cutting mechanism as set forth in claim 8, wherein the feed mechanism further includes a rotational drive mechanism for rotating the workpiece about the longitudinal axis of the workpiece.

11. A bending device with a cutting mechanism for at least one of bending and cutting a workpiece, the bending device comprising:

at least one bending die having a bending surface corresponding to a target bending shape;

a clamping die disposed adjacent and movable toward the bending die for clamping the workpiece against the bending die;

a rotation mechanism for rotating the clamping die around a bending axis while the workpiece is clamped between the clamping die and the bending die for at least one of bending the workpiece to conform to the target bending shape and positioning the cutter at a desired rotational position for cutting the workpiece; and a cutter movable toward the workpiece for cutting the workpiece;

wherein the rotation mechanism supports both the clamping die and the cutter such that the both the clamping die and the cutter rotate along with the rotation mechanism such that the cutter is positionable at the desired rotational position for cutting the workpiece.

* * * * *